United States Patent [19]

Falk et al.

[11] 4,209,999

[45] Jul. 1, 1980

[54] HOUSEHOLD REFRIGERATOR WITH THROUGH-THE-DOOR ICE SERVICE

[75] Inventors: Donald G. Falk, Taylorsville; William J. Armstrong, Jeffersontown, both of Ky.

[73] Assignee: General Electric Company, Louisville, Ky.

[21] Appl. No.: 914,634

[22] Filed: Jun. 12, 1978

[51] Int. Cl.[2] ..... F25C 5/18

[52] U.S. Cl. ..... 62/344; 141/362; 200/61.7

[58] Field of Search ..... 62/344, 377; 222/52, 222/56; 141/360-362; 200/61.62, 61.69, 61.70

[56] References Cited

U.S. PATENT DOCUMENTS

| | | | |
|---|---|---|---|
| 1,841,275 | 1/1932 | Baptiste | 141/362 X |
| 3,341,065 | 9/1967 | Schuldt et al. | 222/1 |
| 3,537,132 | 11/1970 | Alvarez | 62/266 |
| 3,537,273 | 11/1970 | Alvarez | 62/344 X |
| 3,545,217 | 12/1970 | Linstromberg | 62/137 |
| 3,572,053 | 3/1971 | Jacobus | 62/344 |
| 3,715,119 | 2/1973 | Shelley et al. | 222/241 |
| 3,747,363 | 7/1973 | Grimm | 62/377 |
| 3,798,923 | 3/1974 | Pink et al. | 62/266 |
| 3,902,331 | 9/1975 | True, Jr. et al. | 62/137 |
| 3,942,334 | 3/1976 | Pink | 62/344 X |
| 4,100,581 | 7/1968 | Slack et al. | 200/61.62 X |

*Primary Examiner*—William E. Wayner
*Assistant Examiner*—William E. Tapolcai, Jr.
*Attorney, Agent, or Firm*—Frederick P. Weidner; Radford M. Reams; Sughrue, Rothwell, Mion, Zinn & Macpeak

[57] ABSTRACT

A refrigerator having a freezer compartment with a primary door and an automatic motor-driven ice dispenser within the freezing compartment. The ice dispenser includes an ice mold, an ice ejecting arrangement, a receptacle for receiving ice pieces from the mold, and a rotatable dispensing means positioned within the receptacle for moving the ice pieces through the receptacle and discharging the ice pieces from an opening in the receptacle. There is provided a passage through the primary door for receiving the ice pieces from the receptacle outlet when the primary door is closed. A recess is in communication with the passage and has an opening in the exterior surface of the primary door. The recess has a secondary door hingedly secured to the primary door that seals the opening on the exterior surface of the primary door. An arrangement for actuating the dispenser cooperates with the secondary door to energize that dispenser during the opening of the secondary door whereupon ice pieces are delivered through the receptacle outlet, the primary door passage, and into the recess.

10 Claims, 4 Drawing Figures

HOUSEHOLD REFRIGERATOR WITH THROUGH-THE-DOOR ICE SERVICE

BACKGROUND OF THE INVENTION

The present invention is directed to a household refrigerator including a freezer compartment having an access door. Contained in the freezer compartment is an automatic motor driven ice dispenser comprising an ice mold, means for ejecting ice pieces from the mold, a receptacle for receiving the ice pieces from the mold, and a rotatable dispensing means positioned within the receptacle for moving the ice pieces through the receptacle and discharging the ice pieces from an opening in the receptacle.

U.S. Pat. No. 3,572,053-Jacobus et al and U.S. Pat. No. 3,640,088-Jacobus et al disclose household refrigerators including exterior ice services including an ice passage in a freezer door and combination receptacle and dispensing means for delivering batches of ice pieces from the receptacle to the passage. The dispensing means is motor operated and designed to deliver batches of ice pieces periodically to the passage during operation of the motor.

U.S. Pat. Nos. 2,212,405-Rose et al and 2,697,918-Comstock disclose exterior surface ice servicers in which ice pieces are dispatched directly from an ice maker through a cabinet wall or the cabinet door, the amount of ice available at any one time being limited by the storage capacity of the ice makers.

U.S. Pat. No. 3,602,007-Drieci discloses through-the-door ice service comprising a receptacle mounted on the interior surface of a small ice access door provided in the main or primary freezer door so that the ice stored in the receptacle is available exteriorly by opening the pivoted ice access door without opening the main freezer door.

The present invention is directed to an exterior ice service combining the advantages of an ice storage receptacle for storing a relatively large amount of ice pieces with a manually-operable ice disdispensing means for dispensing batches of ice without opening the primary freezer door.

SUMMARY OF THE INVENTION

There is provided a refrigerator having a freezing compartment with a primary door and an automatic motor driven ice dispenser within the freezing compartment. The automatic ice dispenser includes an ice mold, means for ejecting ice pieces from the mold, a receptacle for receiving the ice pieces from the mold, and a rotatable dispensing means positioned within the receptacle for moving the ice pieces through the receptacle and discharging the ice pieces from an opening in the receptacle. There is also provided in the primary freezer door a passageway therethrough for receiving the ice pieces from the receptacle outlet when the primary door is closed. The primary door has a recess which is in communication with the passage and has an opening in the exterior surface of the primary door. The recess has a secondary door hingedly secured to the primary door for sealing the recess opening on the exterior surface of the primary door. Actuating means are provided and cooperate with the secondary door to energize the ice dispenser during the opening of the secondary door whereupon ice pieces are delivered through the receptacle outlet, the primary door passage, and into the recess.

DESCRIPTION OF THE PREFERRED EMBODIMENT

Figure 1:
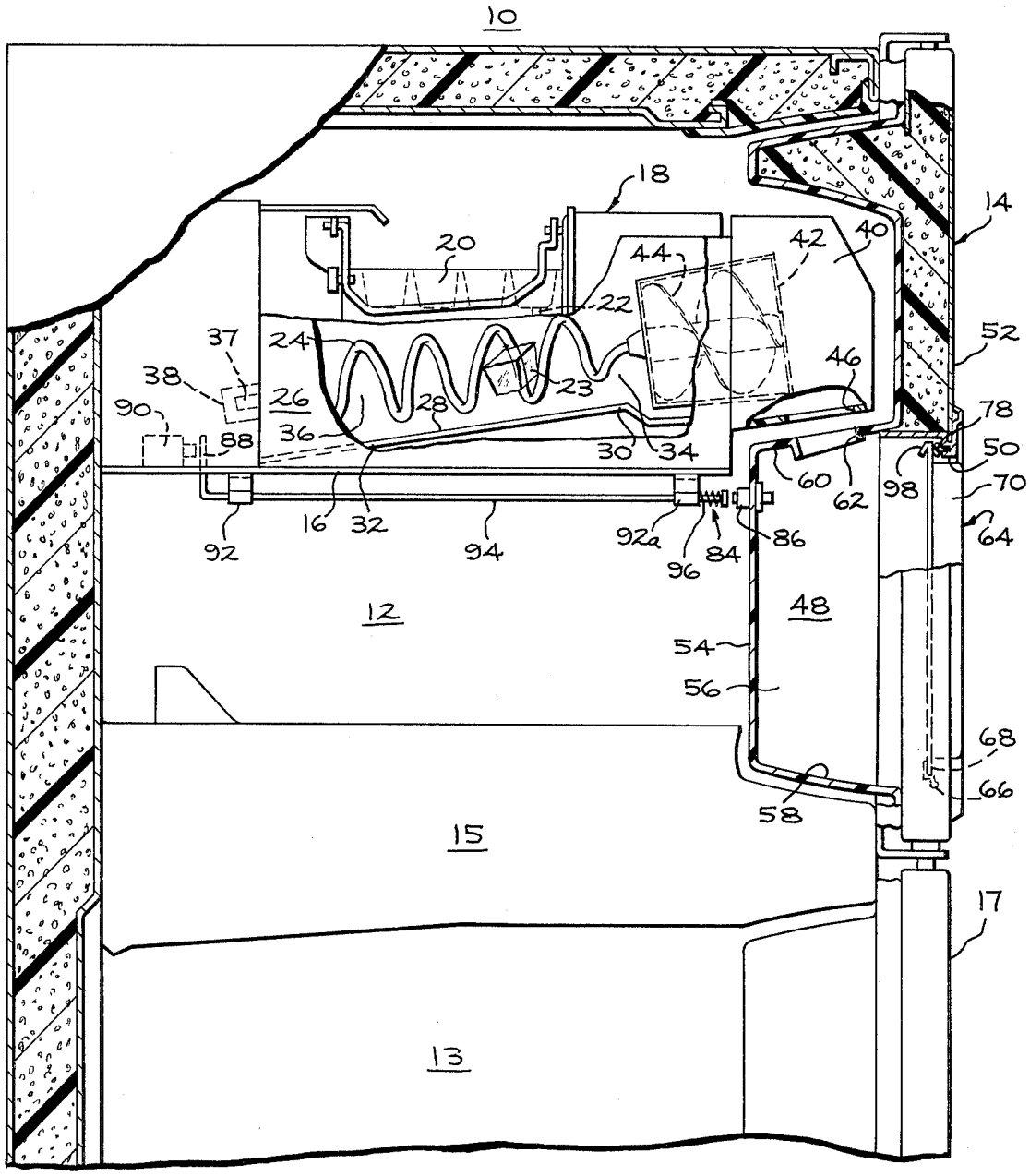
FIG. 1 is a side elevational view, partly in section, of the upper portion of a refrigerator showing both the fresh food compartment and the freezer compartment and including the ice dispenser means of the present invention.

Referring to FIG. 1, a refrigerator 10 such as a household refrigerator, for example, has a freezing compartment 12, and a fresh food compartment 13 separated by an insulating partition 15. The freezer compartment has a main or primary door 14 and the fresh food compartment has a door 17 for closing the respective compartments. Within the freezing compartment 12 there is a shelf 16 and an automatic ice dispenser 18. The automatic ice dispenser 18 comprises an ice mold 20, means 22 for ejecting formed ice pieces 23 from the mold 20 into a receptacle 26, and a rotatable dispensing means 24 positioned within the receptacle 26 for moving ice pieces through the receptacle 26 and discharging said ice pieces from said receptacle 26, as is known in the art.

The receptacle 26 is supported by the shelf 16 and as shown in FIG. 1, is positioned laterally adjacent and extends along the length of the mold 20. The receptacle 26 has a floor 28 having forward and rearward end portions 30, 32. The floor 28 extends downwardly and rearwardly from the forward end portion 30 to said rearward end portion 32 for urging ice pieces 23 within the receptacle 26 to the rearward end portion 32 of said receptacle.

The rotatable dispensing means 24 is a helical element having an axis (not shown) such as a helical tube or auger, for example. The rotatable dispensing means 24 has forward and rearward end portions 34, 36, respectively, and is removably connected at one end thereof 37 to a power supply 38 for rotating the rotatable dispensing means 24 and moving ice pieces 23 along the receptacle 26 and discharging said pieces therefrom via a housing 40 which can contain, if desired, an ice crusher (not shown).

The rotatable dispensing means 24 extends upwardly and forwardly from said rearward end portion 36 to said forward end portion 34. Preferably, the rotatable dispensing means 24 and the receptacle floor 28 are angularly inclined from the horizontal at a common angle preferably in the range of about 5° to about 15° from the horizontal to assure movement of the ice pieces 23 within the receptacle while maintaining the energy required for dispensing means 24 at a low value.

The receptacle 26 includes a discharge opening 42. Upon rotation of the dispensing means 24, ice pieces stored in the receptacle 26 are advanced by a screw conveyor 44 to the opening 42 through which batches of ice pieces are discharged into the housing 40. The housing 40 has an opening 46 in the bottom thereof through which the ice pieces will pass.

Figure 2:
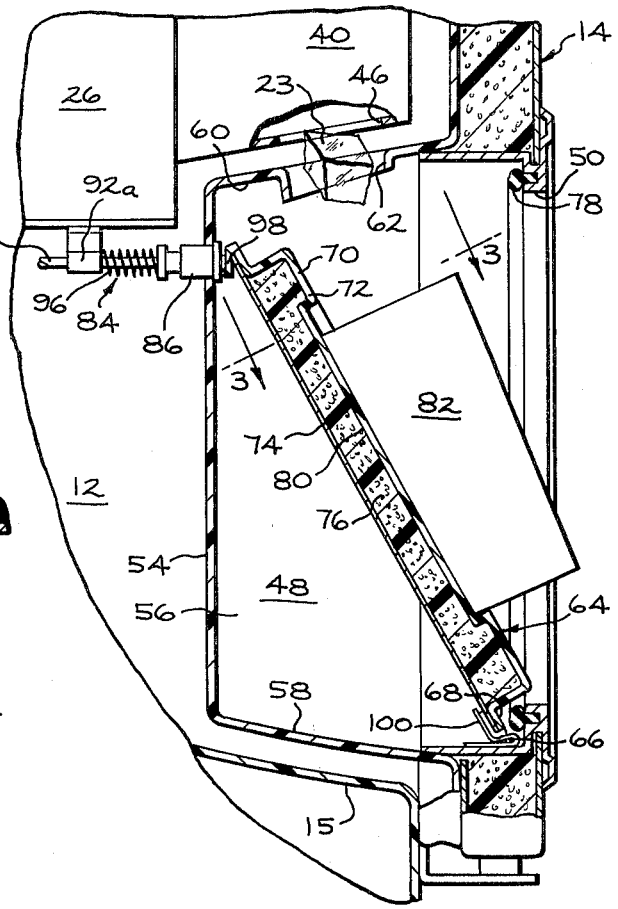
FIG. 2 is a sectional view showing the secondary door in the open position to receive ice pieces from the ice dispenser means of the present invention.
Figure 3:
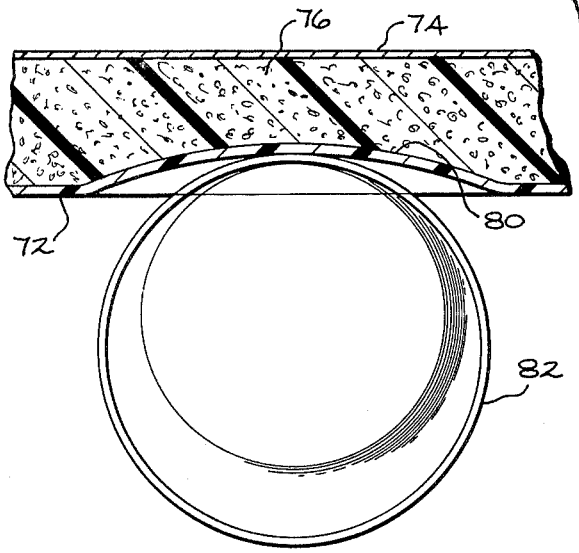
FIG. 3 is taken along line 3—3 of FIG. 2.

With reference to FIGS. 1–3 there now will be described the structural arrangement for receiving the ice pieces through the freezer primary door 14 without the need to open it. There is provided a recess 48 in the primary door 14 and the recess has an opening 50 on the exterior surface 52 of the primary door 14. The recess 48 is dimensioned to receive therein a drinking glass or other container to receive ice pieces and has a rear wall 54, side walls 56, bottom wall 58 and top wall 60. Top wall 60 has a passage 62 which in effect is a passage through the primary door and is in communication with opening 46 of housing 40 for receiving ice pieces 23 that pass through the opening 46.

To thermally seal the opening 50 through the primary door 14 there is provided a secondary door 64 which is secured to the primary door by hinges 66 located along the lower edge 68 of the secondary door 64. By this arrangement then the upper portion 70 of the secondary door may swing inwardly into the recess 48 to a position shown in FIG. 2. The secondary door, for thermal insulation purposes, is double walled having an outer wall 72 and an inner wall 74 with suitable insulation 76 therebetween. There is also provided a sealing gasket 78 around the recess opening 50 against which the secondary door 64 will abut when it is in the closed position as shown in FIG. 1.

By this arrangement then the primary door 14 is thermally insulated on the exterior surface thereof and eliminates the need for thermal insulation between the housing 40 in the freezer compartment 12 and the interior of the recess 48.

In operation then the through-the-door ice service is accomplished by the user placing a container, such as a drinking glass, against the outer wall 72 of the secondarily door 64 and pushing inwardly to move or swing the upper portion 70 of the door into the recess 48. The ease of movement of the secondary door 64 will be enhanced by providing the outside wall 72 of the secondary door 64 with an inwardly bowed portion 80 which is particularly shown in FIG. 3. The inwardly bowed portion 80 also helps the user to have the container 82 in proper orientation or position to receive the ice pieces during the dispensing operation. During the inward movement of the secondary door 64 the ice dispenser 18 is energized. To accomplish this there is provided a push rod assembly 84 which has one end 86 secured to the rear wall 54 of the recess 48 and the opposite end 88 positioned adjacent a switch 90 which is a normally open switch and when closed completes an electrical circuit to energize the ice dispenser. Intermediate the ends 86 and 88 of the push rod assembly there are provided supports 92 and **92*a* that retain the push rod 94 in its proper position but allows the push rod to move axially therethrough back and forth. The push rod assembly 84 also includes a spring 96 that urges or biases the push rod toward the recess 48. The upper portion 70 of the secondary door 64 has a downwardly turned lip 98 which when the door 64 is opened engages the push rod assembly 84 and overcomes the bias effect of spring 96 causing push rod 94 to be moved in a direction away from the recess 48. By such movement the opposite end 88 of the push rod engages normally open switch 90 and closes the switch thereby energizing the ice dispenser. When the ice dispenser is energized the ice pieces are delivered through the receptacle outlet 46, the primary door passage 62 and into the recess whereupon they drop into container 82 as shown in FIG. 2. When the user has received sufficient ice pieces the container 82 is removed from within the recess 48 and secondary door 64 automatically returns to its closed position by a biasing means such as a hinge associated spring 100 whereupon the opening 50 in the primary door 14 is thermally sealed. The push rod 94 is by spring 96 moved toward the recess 48 thus de-energizing the ice dispenser by switch 90** being opened.

Figure 4:
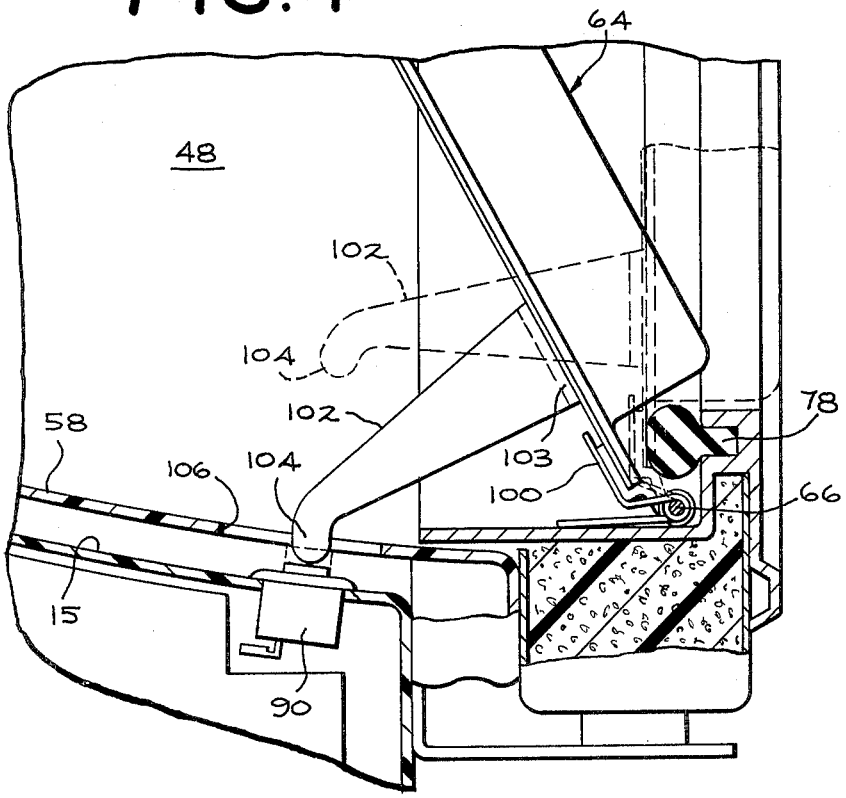
FIG. 4 is an enlarged sectional view showing an alternate embodiment of the secondary door for actuating the ice dispenser means of the present invention.

FIG. 4 shows an alternate embodiment wherein the ice dispenser switch 90 is not closed by a push rod assembly but rather it is closed by a rigid arm 102 secured to the secondary door 64 and by having the switch 90 located in close proximity to the secondary door and the rigid arm 102. The rigid arm 102 has one end 103 secured to the inner wall 74 of the secondary door 64 by suitable means and the opposite end is a free, downwardly directed hook portion 104. The bottom wall 58 of the recess 48 is provided with an opening 106 through which the downwardly directed hook portion 104 will pass when the secondary door is moved inwardly. The switch 90 is secured to the partition 15 between the freezer compartment and the fresh food compartment below the opening 106. As shown in dotted lines when the secondary door is closed the rigid arm 102 is out of engagement with the switch 90 and when the door is opened, as shown in solid line, the rigid arm is moved downwardly with the hook portion 104 passing through the opening 106 to engage the switch 90 to close the switch thus operating the ice dispenser as described above.

Although there has been shown and described two embodiments of the present invention, it is to be understood that the invention is not limited thereto and it is intended by the appended claims to cover all such modifications falling within the spirit and scope of the invention.

What is claimed is:

1. A refrigerator having a freezing compartment with a primary door and an automatic motor driven ice dispenser within the freezing compartment actuated by a switch, the automatic ice dispenser comprising an ice mold, means for ejecting ice pieces from the mold, a receptacle for receiving the ice pieces from the mold, and a rotatable dispensing means positioned within the receptacle for moving the ice pieces through the receptacle and discharging the ice pieces from an opening in the receptacle;

the primary door includes a passage therethrough for receiving the ice pieces from the receptacle outlet when the primary door is closed and a recess in communication with the passage and having an opening in the exterior surface of the primary door;

the recess has a secondary door hingedly secured to the primary door that seals the opening on the exterior surface of the primary door;

the switch is located remote from the freezer door; and actuating means cooperating with the secondary door to actuate the switch and energize the dispenser during the opening of the secondary door whereupon ice pieces are delivered through the receptacle outlet, the primary door passage, and into the recess.

2. A refrigerator according to claim 1 wherein the secondary door is hingedly secured at the bottom thereof to the primary door.

3. The refrigerator according to claim 1 wherein the recess has a sealing gasket around the recess opening in the exterior surface of the primary door against which the secondary door abuts when the secondary door is closed.

4. The refrigerator according to claim 1 wherein the secondary door is thermally insulated.

5. The refrigerator according to claim 1 wherein the secondary door has an outside panel which is bowed inwardly and dimensioned to receive a drinking glass.

6. The refrigerator according to claim 2 wherein the actuating means for energizing the dispenser is located to provide cooperative engagement with the end of the secondary door remote from the hinged end.

7. The refrigerator according to claim 6 wherein the actuating means includes a spring biased push rod that closes a normally open switch for energizing the dispenser when the secondary door is opened.

8. The refrigerator according to claim 1 wherein the actuating means cooperating with the secondary door to energize the dispenser includes a rigid arm secured to the secondary door which closes a normally open switch for energizing the dispenser when the secondary door is opened.

9. The refrigerator according to claim 1 wherein the secondary door automatically returns to a closed position after delivery of the ice pieces.

10. The refrigerator according to claim 9 wherein the secondary door is automatically returned to the closed position by a spring biasing means.

* * * * *